US005111912A

United States Patent [19]

Kempf

[11] Patent Number: 5,111,912

[45] Date of Patent: May 12, 1992

[54] SPRING-LOADED DRIVE ASSEMBLY FOR A WHEELCHAIR LIFT

[75] Inventor: Dale Kempf, Modesto, Calif.

[73] Assignee: Hogan Mfg., Inc., Escalon, Calif.

[21] Appl. No.: 701,681

[22] Filed: May 15, 1991

Related U.S. Application Data

[63] Continuation-in-part of Ser. No. 629,117, Dec. 17, 1990.

[51] Int. Cl.[5] ..... B66B 11/22

[52] U.S. Cl. ..... 187/17; 187/8.71; 187/8.72; 414/921; 414/546; 280/166

[58] Field of Search ..... 187/17, 8.71, 8.72, 187/8.57; 414/921, 546, 548, 549, 556, 557; 105/445, 449; 280/163, 166

[56] References Cited

U.S. PATENT DOCUMENTS

| | | | |
|---|---|---|---|
| 872,902 | 12/1907 | Comer et al. . | |
| 883,443 | 3/1908 | Berg . | |
| 924,537 | 6/1909 | Crofut, Jr. . | |
| 948,874 | 2/1910 | Crofut, Jr. . | |
| 1,105,202 | 7/1914 | King . | |
| 1,419,992 | 6/1922 | Szczurek . | |
| 2,256,389 | 9/1941 | Griffith . | |
| 4,273,498 | 6/1981 | Dickhart et al. | 414/921 X |
| 4,499,970 | 2/1985 | Hussey | 414/921 X |
| 4,823,895 | 4/1989 | Kimball | 180/6.48 |

*Primary Examiner*—Robert P. Olszewski
*Assistant Examiner*—Dean A. Reichard
*Attorney, Agent, or Firm*—Christensen, O'Connor, Johnson & Kindness

[57] ABSTRACT

A drive assembly (250) for use with a platform lift. The assembly includes a set of linkage arms (30, 32) connected between the platform (22) and a stable carriage arm (34). A pair of sprockets (50, 60) connected to the carriage arm at the linkage arm pivot points control the rotation of the linkage arm and the movement of the platform relative to the carriage arm. The sprokets are connected together by a leaf chain assembly (70) so as to show rotation of the sprockets in a simultaneous movement of the linkage arms. A compression spring (260) is attached at one end to the leaf chain assembly and at the other end to the carriage arm. When the platform is moved into the top-most position, the spring is compressed. The platform is lowered by allowing the spring to expand so that it actuates the leaf chain assembly so as to cause the linkage arms to move past their top-center positions; once the linkage arms move past their top-center positions, gravity can then force the platform downwards.

15 Claims, 5 Drawing Sheets

SPRING-LOADED DRIVE ASSEMBLY FOR A WHEELCHAIR LIFT

RELATIONSHIP TO OTHER APPLICATIONS

This application is a continuation-in-part of U.S. patent application Ser. No. 07/629,117 filed Dec. 17, 1990 for a Leaf Chain Drive Assembly.

FIELD OF THE INVENTION

This invention relates to improvements in platform lifts of the type used in buses and other vehicles, and more particularly to drive assemblies used in such lifts for causing the platform to raise and lower.

BACKGROUND OF THE INVENTION

Platform-type wheelchair lifts of the type disclosed in U.S. Pat. No. 4,058,228 to Hall have been used extensively in passenger vehicles, particularly urban buses. Platform lifts of the type disclosed in the Hall patent are typically installed in one of the existing stairwells in a vehicle. These lifts generally comprise a platform which is slidably mounted in the vehicle beneath the stairwell so as to define the bottom step of the stairwell when in the retracted position and so as to provide a platform which projects outwardly from the stairwell when in the extended position. The platform is attached via a parallelogram linkage assembly to a carriage. The latter is slidably mounted in a pair of opposing channel members and is caused to move between retracted and extended positions by a chain drive assembly which is actuated by a hydraulic or pneumatic linear actuator. The parallelogram linkage assembly is designed to cause the platform to move between upper and lower positions relative to the carriage when the platform is in the extended position. The parallelogram linkage includes two pairs of parallel linkage arms, each arm having a proximal end which is pivotally mounted to the carriage and a distal end which is pivotally mounted to the platform.

The linkage arms are caused to pivot about their proximal ends, thereby causing the platform to move between upper and lower positions, by a sprocket and chain drive assembly. This assembly includes a toothed driving sprocket coupled with the proximal end of one of the parallel arms so as to rotate with the arm and a driven toothed sprocket attached to the proximal end of the other arm so as to rotate with the arm. Rotational drive is transmitted from the driving sprocket to the driven sprocket by a chain drive assembly comprising a single length of leaf chain. One end of the leaf chain is wrapped partially around and is attached to the driving sprocket and the other end of the leaf chain is wrapped partially around and is attached to the driven sprocket. The driving sprocket is driven by a separate chain and sprocket drive assembly which is rotated by a actuator mechanism. In an alternative embodiment of the above-described chain drive assembly, two lengths of roller chain are employed, each of which is wrapped around a respective one of the sprockets. Two turnbuckles are provided for coupling the ends of the roller chains together so as to form a continuous flexible drive member. A preload can easily be applied to chain assembly of the alternative embodiment by appropriate adjustment of the turnbuckles.

Platform lifts of the type described above have been used extensively in urban buses with very favorable results. Recently, the need has arisen (a) to increase the length of the parallel linkage arms of known platform lifts, (b) to increase the size, and hence weight, of the platform of known platform lifts, and (c) to accommodate heavier loads on known platform lifts. However, due to space limitations inherent in the design of the above-described platform lifts, it has not been possible to accommodate A roller chain in the chain and sprocket drive assembly of such lifts of a size, and hence strength, sufficient to permit the lift to be modified in the manner described in the preceding sentence.

Under conventional operation, the parallel arms of platform lifts of the type disclosed in U.S. Pat. No. 4,058,228 are caused to travel between a downwardly projecting position, through a horizontal position, to an upwardly projecting position. As the arms travel through the horizontal position, the tendency exists for the platform of the lift to "buck" or bounce. Such "bucking" is believed to occur due to stretching of the inherently flexible roller chains used in the chain and sprocket drive assembly which arises when the load applied to the roller chains is shifted from the linkage assembly to the chains as the parallel arms move from the upwardly projecting to the downwardly projecting positions, or vice versa. As those who have experienced anomalous vibration or bouncing of elevators can appreciate, such "bucking" of the platform lift can be very disconcerting to a wheelchair occupant positioned on the lift.

In an attempt to minimize the "bucking" of the platform of conventional platform lifts which occurs as the parallel arms travel through the horizontal position, a significant preload has been applied to the roller chains. Although such preloading does reduce the tendency of the platform to "buck," it simultaneously increases the load on the bearings and the strain on the chain, sprockets, and other components of the chain and sprocket drive assembly. Also, the friction between movable components of the chain and sprocket drive assembly is increased as a consequence of such preloading. Such increases in load, strain, and friction result in added maintenance costs and reduced product longevity.

Moreover, many platform lifts are designed so that gravity provides the force needed to move the platforms from the "floor" position adjacent the floor of the vehicle to either the stowed position or the full deployed, ground, position. Problems arise when a platform is in the floor position, because the linkage arms may be at or near a top-center relative to their pivot shafts. When the linkage arms approach this position, gravity may not be able to immediately overcome friction forces that hold the arms in place. As a result, when the linkage arm actuating mechanism that controls the movement of a platform is released, the arms may momentarily be frozen until gravity overcomes the friction forces so as to move the lift downwards. The platform will then momentarily move downwards in a free fall until the actuating mechanism catches the linkage arms so as to control the rate at which the platform descends. As a result, the platform may be subjected to a jolting movement which unnecessarily strains the components forming the lift and which a passenger may find disconcerting.

In order to provide a "push-off" force for initially moving the platform away form the associated vehicle floor and the linkage arms away from their top-center positions, many lifts are provided with a spring-loaded torque shaft assembly. This assembly includes a torque shaft that extends between the two opposed driving sprockets and a torsion spring that extends between the bar and adjacent fixed portion of the frame of the lift assembly. As the platform moves upwards to the floor position, the spring is wound up by the rotation of the torque shaft. When it is time to lower the platform, the spring is allowed to unwind; this motion imparts the necessary push-off force to the linkage arms so that they move past their top-center lines. Gravity is then able to move the platform downward to the desired lowered position.

A disadvantage of spring-loaded torque shaft assemblies is that in order to install such an assembly, the torque shaft must be formed out of two separate rods that are linked together by a coupling member. The expense of providing a three-piece torque shaft adds to the overall cost of manufacturing and installing the platform lift. Furthermore, a three-piece torque shaft is inherently weaker and less able to transfer rotational power than a one-piece shaft of comparable size. Also, the springs used in these assemblies are inherently weak, and given that they are exposed to extreme and repetitive stress, they are prone to break. Still another disadvantage of these spring-loaded torque shaft assemblies is that the torsion springs are located near the center of the lift assemblies in which they are installed. This makes replacing the springs a complicated and time-consuming task.

SUMMARY OF THE INVENTION

The present invention is a drive assembly designed for use with a platform lift of the type comprising a platform, a carriage assembly, and a linkage assembly coupled with the platform and the carriage assembly for causing the platform to move upwardly and downwardly along a circular arc relative to the carriage. The linkage assembly comprises first and second linkage arms with the proximal end of the first linkage arm being pivotally mounted to the carriage so as to be rotatable about a first axis, and the proximal end of the second linkage arm being pivotally mounted to the carriage so as to be rotatable about a second axis. The drive assembly further includes a leaf chain assembly for simultaneously rotating the linkage arms about their respective carriage pivot points. The leaf chain assembly comprises a first sheave and a second sheave, each comprising a radially projecting lug. The first sheave is coupleable with the first linkage arm so as to rotate with the first linkage arm about the first axis, and the second sheave is coupleable with the second linkage arm so as to rotate with the second linkage arm about the second axis. The leaf chain assembly also comprises two leaf chains which are coupled together so as to surround and engage the first and second sheaves. The leaf chains each comprise an extended connecting link designed to engage the radially projecting lugs on the first and second sheaves so as to permit rotational drive to be transmitted between the first and second sheaves and the leaf chains.

The leaf chain drive assembly further comprises a third sheave coupled to rotate with the first sheave, and a third leaf chain wrapped around the third sheave. One end of the third leaf chain is attached to the third sheave and the other end of the third leaf chain is attached to a linear actuator. As the linear actuator causes the other end of the third leaf chain to reciprocate, the third leaf chain will cause the third sheave to rotate, thereby imparting rotational drive to the first sheave which is coupled with the third sheave.

The drive assembly of this invention further includes a spring-loaded turnbuckle assembly for providing the necessary push-off power to move the linkage arms from their floor position, away from their top-center positions so that gravity can readily move the associated platform downward. The spring-loaded turnbuckle assembly includes a turnbuckle which connects the two chain sections that interlock the linkage arm sprockets for simultaneous rotation. In a preferred embodiment of the invention, the turnbuckle is used to couple the aforementioned leaf chain sections together. A double ended traveling lug is attached at one end to the turnbuckle to move in unison with the turnbuckle when the sprockets are rotated. The second end of the traveling lug slides over a guide rod that is fixed to a carriage arm to which the linkage arm sprockets are attached. A spring is disposed over the guide rod adjacent the traveling lug. The spring is positioned so that when the platform is raised to the floor position, it is compressed against the traveling lug.

When a platform with which this drive assembly is employed is raised to the floor position, the spring is compressed along the fixed rod. When it is time to lower the platform, the spring is allowed to expand so as to move the traveling lug and the turnbuckle. The movement of the turnbuckle forces the linkage arms past their top-center positions so that gravity can move the platform downwards.

An advantage of the spring-loaded turnbuckle of the drive assembly of this invention is that the need to provide a spring-loaded torque shaft is eliminated. Consequently, relatively inexpensive and mechanically strong one-piece torque shafts can be installed in platform lifts where previously three-piece torque shaft bars were employed. Also, a relatively strong coil spring can be used with the drive assembly of this invention wherein previously a breakage-prone torsion spring was used for the same purpose. Moreover, the turnbuckle of this invention employs a coil spring which is located with the outer components of the platform lift assembly. Thus, accessing the springs for repair or replacement is a relatively simple task.

DETAILED DESCRIPTION OF THE PREFERRED EMBODIMENT

Figure 1:
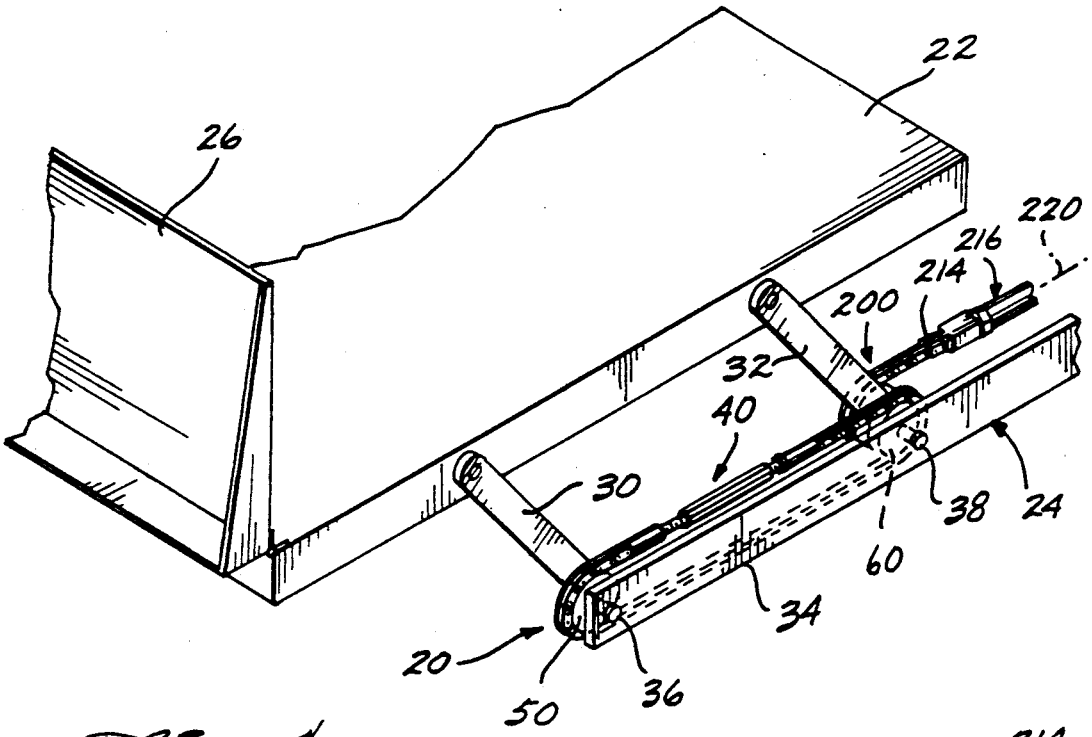
FIG. 1 is a fragmented, perspective view of a portion of a platform lift incorporating the chain and sprocket drive assembly of the present invention, with the parallel arms of the lift being shown in the upwardly projecting position.

The present invention is a drive assembly 20 which is designed to replace roller chain drive assemblies of the type used in platform lifts disclosed in U.S. Pat. No. 4,058,228 to Hall, which lifts shall be referred to hereinafter as "platform lifts." FIG. 1 illustrates a conventional platform lift and one embodiment of the leaf chain drive assembly of the present invention incorporated in such lift. As described in detail in U.S. Pat. No. 4,058,228, which is incorporated herein by reference, and as illustrated in FIG. 1, conventional platform lifts include a platform 22 for supporting a passenger such as a wheelchair occupant, and a carriage, one portion of which is identified at 24, for causing the platform to move horizontally between the retracted and extended positions. Platform lifts also typically include a barrier 26 which is pivotally mounted to the outboard end of platform 22. Barrier 26 forms the bottom step in the stairwell in which the platform lift is mounted when the lift is in the retracted position. When the lift is in the extended position, barrier 26 is typically maintained in the position illustrated in FIG. 1 so as to prevent a wheelchair positioned on platform 22 from rolling off the platform.

Platform lifts further comprise a parallelogram linkage assembly for causing platform 22 to move upwardly and downwardly along a circular arc when the platform is in the extended position. This linkage assembly comprises two pairs of parallel arms, one pair of which is illustrated in FIG. 1 and comprises linkage arms 30 and 32. The proximal ends (i.e., the lower ends as illustrated in FIG. 1) of linkage arms 30 and 32 are keyed to pivot shafts 36 and 38, respectively, which shafts are pivotally mounted in spaced relation to carriage bar 34. As a consequence of this arrangement, the proximal ends of linkage arms 30 and 32 are coupled to carriage arm 34 so as to rotate about the pivot axes of pivot shafts 36 and 38, respectively. The distal ends (i.e., the upper ends as illustrated in FIG. 1) of linkage arms 30 and 32 are pivotally mounted to platform 22 so that the spacing between the distal ends of the arms is identical to the spacing between the proximal ends of the arms.

As described in detail below, drive assembly 20 is designed to cause linkage arms 30 and 32 to pivot with pivot shafts 36 and 38, respectively, about the pivot axes of the shafts, thereby causing platform 22 attached to arms 30 and 32 to raise and lower. As described below, drive assembly 20 includes slave chain drive assembly 40 and lift chain drive assembly 200 for causing arms 30 and 32 to pivot in this manner.

Referring to FIGS. 1–6, slave chain drive assembly 40 comprises a driven sheave or pulley 50 having identically sized and shaped lugs 52 and 54 which are spaced apart from one another a predetermined distance, and project along a common radius of the sheave a predetermined distance from the outer circumferential edge of the sheave 50. The specific size, configuration, and relative spacing of projecting lugs 52 and 54 will be described in greater detail below in connection with the description of leaf chain 120. Sheave 50 is keyed to pivot shaft 36 so as to rotate with the pivot shaft.

Slave chain drive assembly 40 includes a driving sheave 60 which preferably has a size and configuration identical to that of sheave 50. Thus, sheave 60 includes a pair of axially spaced, radially projecting lugs, one of which is identified in phantom at 62 in FIG. 3, which are identical to lugs 52 and 54 of sheave 50. Sheave 60 is keyed to pivot shaft 38 so as to rotate with the pivot shaft.

Assembly 40 comprises an endless drive assembly 70 for transmitting rotational drive from driving sheave 60 to driven sheave 50. In the preferred embodiment, drive assembly 70 comprises a leaf chain 72. Leaf chain 72 is a so-called "3–4" leaf chain comprising a plurality of rigid plates which are interconnected by pins 74. More specifically, moving from the top to the bottom of leaf chain 72 illustrated in FIG. 4, the leaf chain comprises outer plates 76, intermediate plates 78 and 80, central plates 82, intermediate plates 84 and 86, and outer plates 88. The ends of each outer plate 76 are aligned with the ends of a corresponding respective center plate 82 and a corresponding respective outer plate 88. Similarly, the ends of a given set of intermediate plates 78, 80, 84, and 86 are aligned with one another. In addition, each set of intermediate plates 78, 80, 84, and 86 is offset one pitch from the associated set of central, and outer plates 76, 82, and 88. This design of leaf chain 72 is preferred, although it is to be appreciated that leaf chains having differing plate configurations may also be satisfactorily employed, the only requirement being that the leaf chain have sufficient strength and stiffness for the intended application, and the cross sectional size of the leaf chain is such that it can be accommodated in the space provided in the platform lift.

Leaf chain 72 also comprises an extended connecting link 100 which is preferably, although not necessarily, positioned at or near the middle of the length of the leaf chain. The extended connecting link comprises an outer plate **100*a* which is positioned along the plane of outer plates 76, an intermediate plate 100*b* which is positioned along the plane of central plates 82, and an outer plate 100*c* which is positioned along the plane of the outer plates 88. With this design of connecting link 100, apertures 102 and 104 are provided in leaf chain 72, which extend entirely through the thickness of the chain. Apertures 102 and 104 in leaf chain 72 are sized and configured, as are the radially projecting lugs (one of which is identified at 62 in FIG. 3) of sheave 60, so that the radially projecting lugs may be received in apertures 102 and 104 with a close sliding fit, whereby rotational motion may be transmitted from sheave 60 to leaf chain 72** without any lost motion.

Leaf chain 72 additionally comprises end fitting 106 which is attached to one end of the leaf chain and end fitting 108 which is attached to the other end of the leaf chain. End fitting 106 comprises a threaded central bore 110 (FIG. 4) having a left hand thread, and end fitting 108 comprises a threaded central bore 112 (FIG. 4) having a right hand thread.

Endless drive belt assembly 70 additionally comprises a second leaf chain 120. Leaf chain 120 is identical to leaf chain 72, and hence comprises an extended connecting link 122 which is identical to connecting link 100, and end fittings 124 and 126 which are identical to end fittings 106 and 108, respectively. Thus, connecting link 122 is designed to receive lugs 52 and 54 of sheave 50 such that motion may be transmitted from the leaf chain to the sheave.

Drive belt assembly 70 further comprises turnbuckles 130 and 132 that connect the leaf chains 72 and 120 together. Turnbuckle 130 comprises a central portion 134 having a hexagonal cross-sectional configuration and threaded ends 136 and 138. Threaded end 136 has a left hand thread and the pitch of the thread is selected so that end 136 may be threadably engaged in threaded bore 110 in end fitting 106 of leaf chain 72. End 138 has a right hand thread, and the thread pitch of the end is selected so that it may be threadably engaged in the central bore in end fitting 126 of leaf chain 120. Turnbuckle 132 has a similar construction with the end having a right handed thread being threadably engaged in central bore 112 in end fitting 108 of leaf chain 72, and the end having a left hand thread being threadably engaged in the central bore of end fitting 124 of leaf chain 120.

Figure 2:
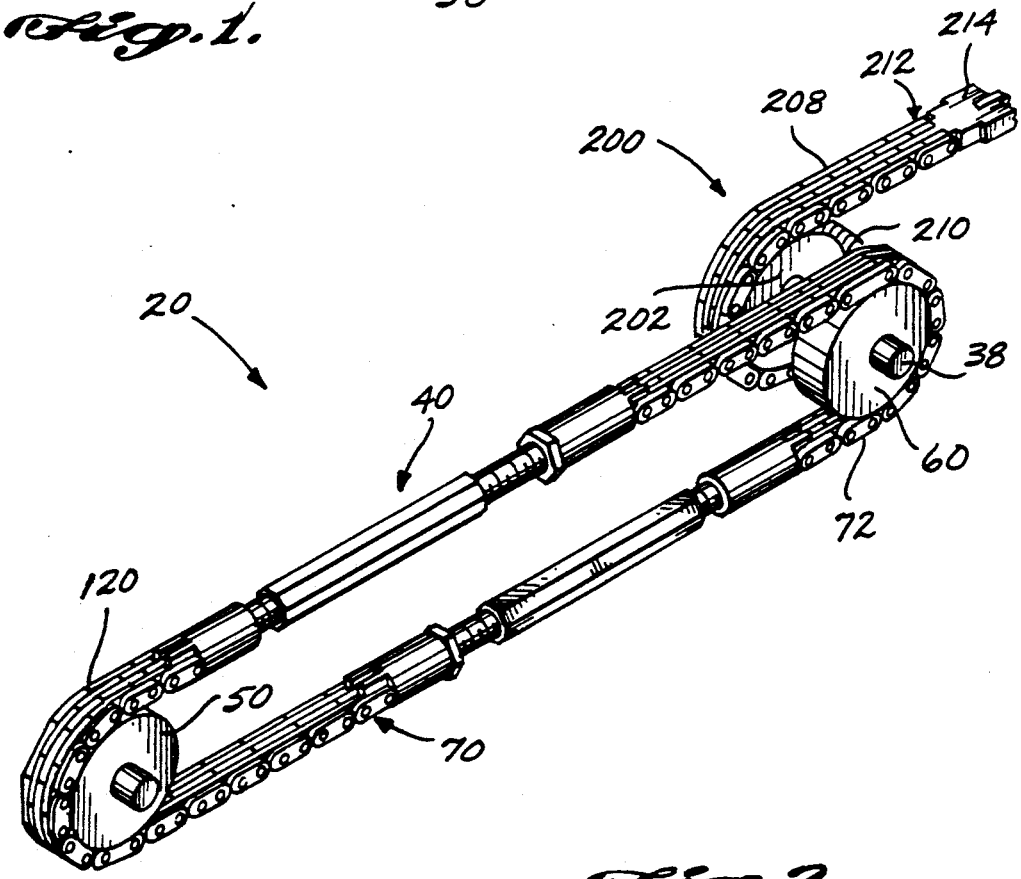
FIG. 2 is an enlarged perspective view of the chain and sprocket drive assembly illustrated in FIG. 1, with associated portions of the platform lift being removed for clarity of illustration.
Figures 3, 4, 5, 6:
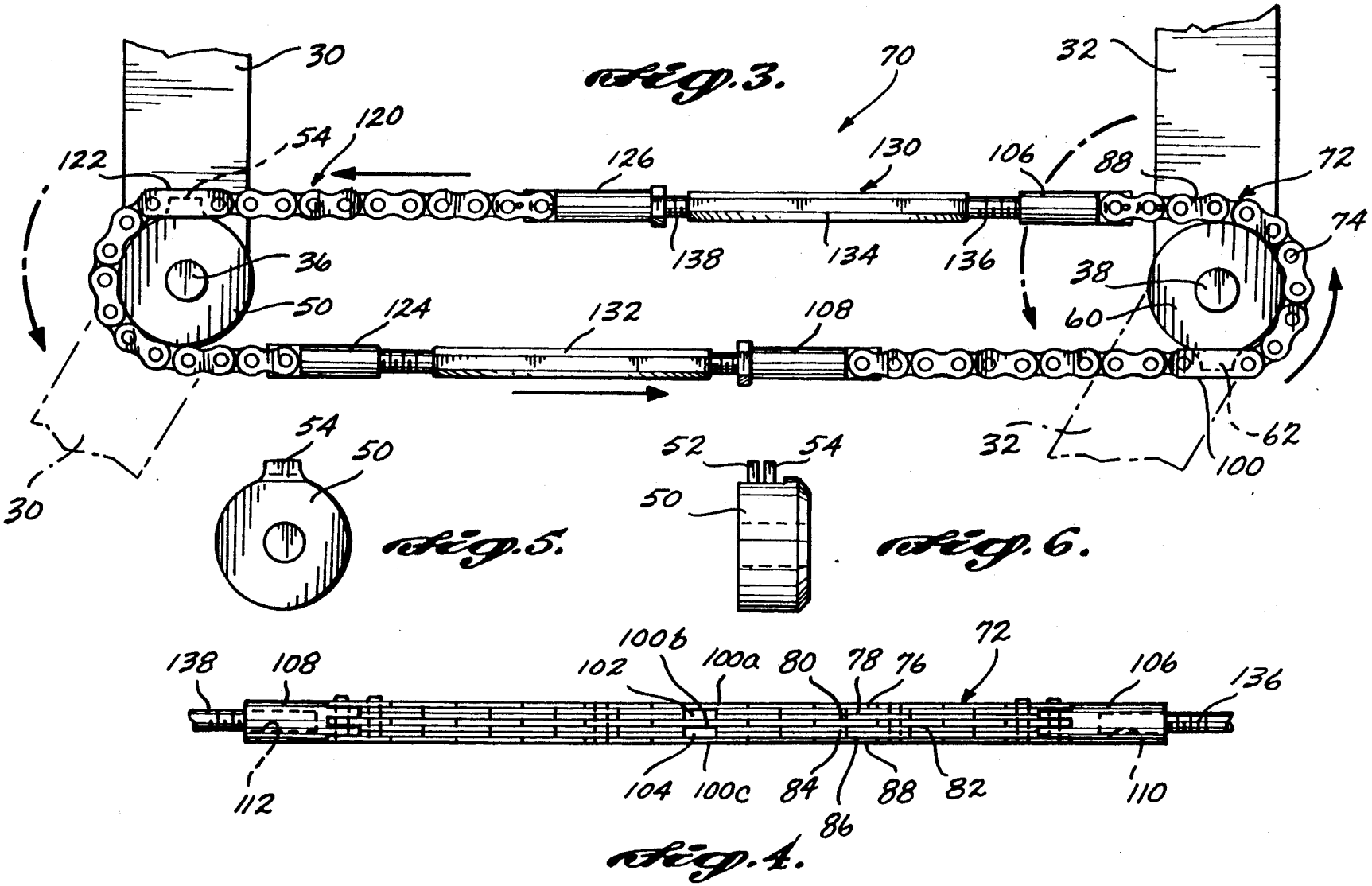
FIG. 3 is a side elevational view of the chain and sprocket drive assembly with the parallel arms of the platform lift which are driven by the chain and sprocket drive assembly being shown in solid view in an upwardly projecting position and in phantom view in a downwardly projecting position.
FIG. 4 is a top view of one of the lengths of leaf chain used in the chain and sprocket drive assembly, with the chain being spread out flat for clarity of illustration.
FIG. 5 is a side elevation view of one of the sprockets used in the leaf and chain drive assembly.
FIG. 6 is a front elevational view of the sprocket illustrated in FIG. 5.

Referring to FIGS. 1 and 2, the leaf chain drive assembly 20 further comprises a lift chain drive assembly 200 for causing sheave 60 to rotate. The lift chain drive assembly comprises a sheave 202 which is keyed to pivot shaft 38 so as to rotate with the shaft. As illustrated in FIG. 1, linkage arm 32 is positioned between sheave 202 and sheave 60, whereby sheave 202, linkage arm 32, and sheave 60 rotate as a unit about the rotational axis of pivot shaft 38.

Lift chain drive assembly 200 further comprises leaf chain 208. The latter is preferably a "3-4" leaf chain of the type used for leaf chains 72 and 120, as described above, except that the size and strength of leaf chain 208 is increased as required to permit leaf chain 208 to withstand the substantially greater forces to which it is subjected. End 210 of leaf chain 208 is affixed to sheave 202 by conventional means so that the end of the leaf chain will rotate with the sheave. In one embodiment of the invention, sheave 202 comprises a pair of radially projecting lugs (not shown) similar to lugs 52 and 54 on sheave 50 as described above. End 210 of leaf chain 208 is then attached to these projecting lugs via a pin (not shown). The opposite end 212 of leaf chain 208 is attached via fitting 214 to linear actuator 216. The latter is provided for causing leaf chain 208 to move back and forth so as to wrap around and unwrap from the periphery of sheave 202, thereby causing the pivot sheave to rotate about its rotational axis. Linear actuator 216 is identical to the corresponding actuator mechanism used in the platform lift described in U.S. Pat. No. 4,058,228. Linear actuator 216 is designed to cause end 212 of leaf chain 208 to move back and forth along actuation axis 220. For a more detailed description of linear actuator 216, attention is directed to the aforementioned patent.

In connection with the following discussion of the operation of leaf chain drive assembly 20, reference should be made to FIGS. 1-6. Initially, end 210 of leaf chain 208 is attached to sheave 202, the leaf chain is wrapped around sheave 202 in the manner illustrated in FIGS. 1 and 2, and end 212 of leaf chain 208 is attached via fitting 214 to linear actuator 216. Leaf chain 72 is wrapped around sheave 60 so that the radially projecting lugs of sheave 60 (one of which is identified at 62 in FIG. 3) are received in apertures 102 and 104 in the leaf chain. Leaf chain 120 is wrapped around sheave 50 in a similar manner so that radially projecting lugs 52 and 54 are received in the apertures of connecting link 122. Turnbuckle 130 is then threadably engaged with end fittings 106 and 126, and turnbuckle 132 is threadably engaged with end fittings 108 and 124. The turnbuckles are then tightened just enough to remove all slack from leaf chains 72 and 120. A significant preload does not have to be applied to leaf chains 72 and 120, as is typically required with the two-chain alternative embodiment (discussed above) of the chain drive assembly used with known platform lifts.

In connection with the following discussion, it is assumed that parallel linkage arms 30 and 32 are in the upwardly extending position illustrated in FIG. 1. When it is desired to move platform 22 to the more elevated floor position adjacent the floor of the vehicle to which the platform is attached, linear actuator 216 is actuated so as to cause end 212 of leaf chain 208 to move inwardly (i.e., to the right as illustrated in FIG. 1) along the actuation axis 220 of the linear actuator 216. As leaf chain 208 moves in this direction, it causes sheave 202 to rotate in the clockwise direction as illustrated in FIGS. 1 and 2. This clockwise rotation is transmitted via pivot shaft 38 to sheave 60 so as to cause the latter to also rotate in a clockwise direction. Additionally, rotation of sheave 202 in a clockwise direction is transmitted via pivot shaft 38 to linkage arm 32 so as to cause the pivot arm to move upwardly and in a clockwise direction about the rotational axis of pivot shaft 38.

Rotation of sheave 60 in a clockwise direction is transmitted via its radially projecting lugs, e.g., lug 62, to leaf chain 72 so as to cause the portion of the leaf chain wrapped around sheave 60 to also rotate in the clockwise direction. Such motion of leaf chain 72 is transmitted via connecting shafts 130 and 132 to leaf chain 120, thereby causing the portion of leaf chain 120 wrapped around sheave 50 to rotate in a clockwise direction. Such movement of leaf chain 120 is transmitted via its connecting link 122 to projecting lugs 52 and 54 and hence to sheave 50 so as to cause sheave 50 to rotate in a clockwise direction. This rotation of sheave 50 is transmitted via pivot shaft 36 to linkage arm 30 so as to cause the linkage arm to rotate about the rotational axis of pivot shaft 36. Thus, when sheave 202 is driven in the clockwise direction, linkage arms 30 and 32 are caused to move along a circular arc in a clockwise direction so as to cause platform 22 to rise relative to carriage arm 34.

On the other hand, when it is desired to lower platform 22 with respect to carriage arm 34, linear actuator 216 is operated so as to cause end 212 of leaf chain 200 to move outwardly (to the left as illustrated in FIG. 1) along actuation axis 220. Such movement of sheave 202 causes linkage arms 30 and 32 to move in a counterclockwise direction along a circular arc so as to cause platform 22 to move outwardly and downwardly with respect to carriage arm 34. As a consequence of the mechanical interconnection provided by a slave chain drive assembly 40, linkage arms 30 and 32 are permitted to move downwardly in a parallel simultaneous fashion.

While the preferred method for connecting sheaves 50 and 60 with drive belt assembly 70 comprises the connecting link and radially projecting lug arrangement described above, it is to be appreciated that other approaches for achieving such connection between the leaf chains and the sheaves also fall within the scope of the present invention.

As illustrated and described above, a leaf chain drive assembly 20 is typically provided on only one side of platform 22. However, in certain operating environments, it may be desirable to provide an assembly 20 on each side of platform 22.

The slave chain drive assembly 70 and lift chain drive assembly 200 of the present invention possess several important advantages over the corresponding roller chain drive assemblies of the platform lift disclosed in U.S. Pat. No. 4,058,228. The cross-sectional size of leaf chains 72, 120, and 208 is similar to that of the corresponding roller chains used in the platform lift described in U.S. Pat. No. 4,058,228 due to size constraints imposed by the environment in which the leaf chains are used. However, leaf chains 72, 120, and 200 are significantly stronger than their roller chain counterparts due to the inherently greater tensile strength of leaf chains. Consequently, the slave chain drive assembly 70 and lift chain drive assembly 200 enjoy a significantly greater margin of safety than their roller chain counterparts used in the platform lift described in U.S. Pat. No. 4,058,228.

Although it is fairly widely known by those of ordinary skill in the art that a leaf chain of a given size has greater tensile strength than a comparably sized roller chain, few ordinary practitioners, even those specializing in the narrow art of chain engineering, appreciate that leaf chains are also stiffer than roller chains of corresponding cross-sectional size. Such additional stiffness is responsible for the dramatic improvement in the operation of platform lifts incorporating the slave and leaf chain drive assemblies of the present invention. More specifically, by utilizing relatively stiff leaf chains in place of their relatively flexible roller chain equivalents, the tendency of platform 22 to "buck" or bounce as parallel linkage arms 30 and 32 are caused to rotate through the horizontal position is eliminated. Elimination of such motion enhances significantly a user's sense of security when riding up or down on platform 22. Moreover, because the leaf chains of assemblies 70 and 200 do not have to be preloaded to the extent required with their roller chain counterparts used in the platform lift of U.S. Pat. No. 4,058,228, the maintenance requirements for the linkage assembly of the platform lift are reduced significantly and the longevity of the various components of the platform lift is increased significantly.

Figure 7:
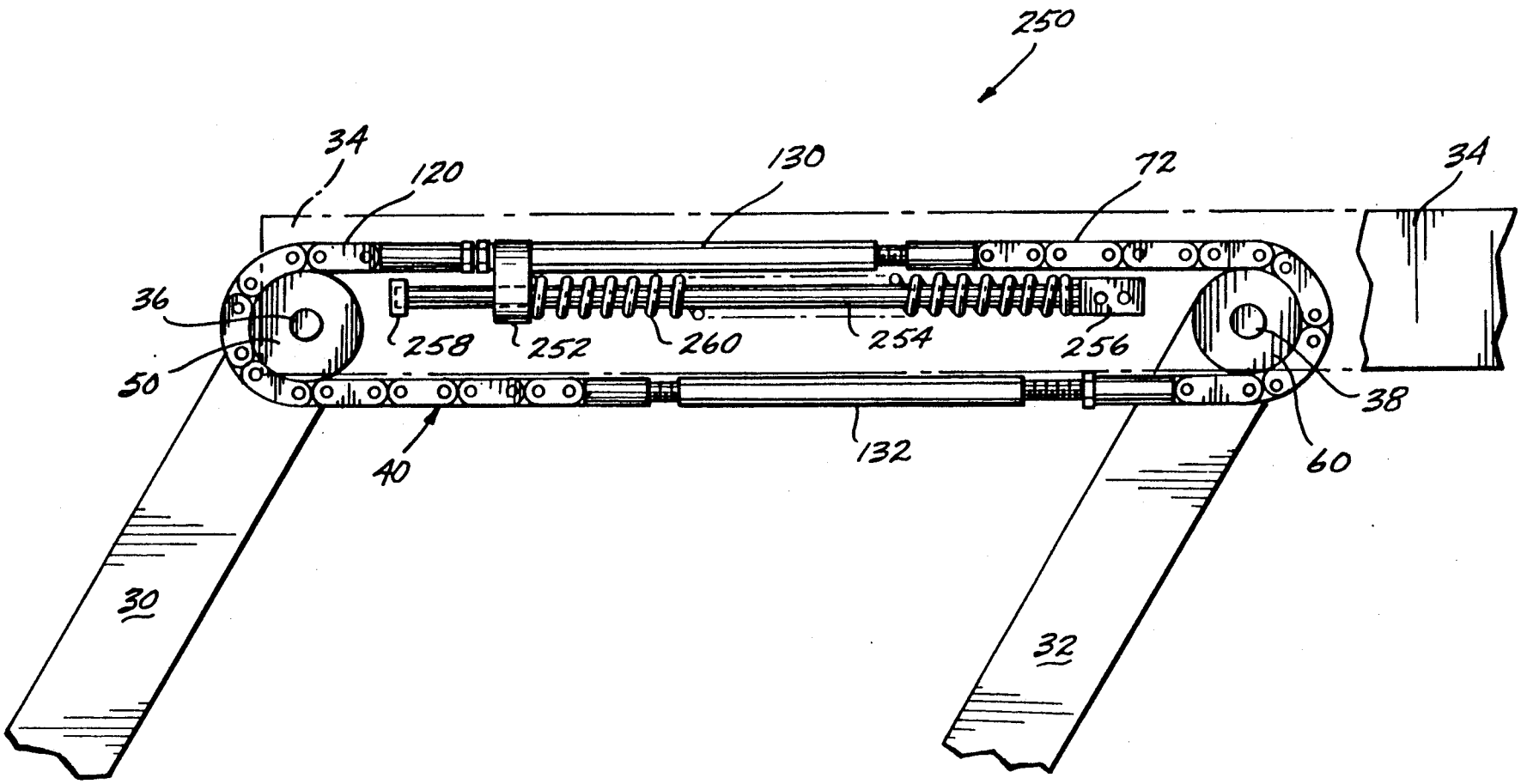
FIG. 7 is a side view alternative embodiment of the leaf chain lift assembly of this invention in which a spring-loaded turnbuckle is employed.

FIG. 7 illustrates an alternative platform lift drive assembly 250 of this invention. Drive assembly 250 includes the same driven sheave 50 and drive sheave 60 described in the first embodiment of this invention for insuring that the linkage arms 30 and 32 rotate simultaneously about their respective pivot shafts 36 and 38. The previously described leaf chains 72 and 120 are used to convert rotational movement of the drive sheave 60 into linear motion, and the previously described leaf chain 120 in combination with the driven sheave 50 is used to convert linear movement into rotational movement. Turnbuckles 130 and 132 are employed to connect the ends of the leaf chains 72 and 120 together.

The top-most turnbuckle, turnbuckle 130, of the drive assembly 250, is spring biased to the associated carriage arm 34 so as to provide a push-off force for moving the linkage arms 30 and 32 away from their top-center positions when the platform 22 is in the fully raised, or floor, position. The turnbuckle 130 is coupled to the carriage arm 34 by a traveling lug 252 that is mounted to a guide rod 254 secured to the carriage arm. The guide rod 254 is secured to the carriage arm 34 by a support lug 256 located adjacent the drive sheave 60. The guide rod 254 is aligned parallel with the turnbuckle 130 and positioned under the area subtended by the turnbuckle 130 as the turnbuckle moves back and forth with the actuation of the drive assembly 250. A threaded fastener 258, or other appropriate cap, is secured over the end of the guide rod 254 opposite the end to which the support lug 256 is attached to retain the traveling lug 252 on the guide rod.

The traveling lug 252 is secured at one end to the end of the turnbuckle 130 adjacent the end fitting 258 and moves in unison with the turnbuckle. In some preferred embodiments of the invention, the traveling lug 252 may be compression fitted to the turnbuckle and/or a fastening pin (not shown) may be used to couple the two components together. The opposed end of the traveling lug 252 is slidably mounted over the fixed guide rod 254. In a preferred embodiment of the invention, the rod 254 is cylindrical and the traveling lug 252 is formed with a bore dimensioned to allow the lug to freely move along the rod.

A helical compression spring 260, shown partially cutaway, is located around the fixed rod 254 between the fixed support lug 256 and the traveling lug 252. In a preferred embodiment of the invention, the assembly 250 is arranged so that the traveling lug 252 does not start compressing the spring 260 until the linkage arms 30 and 32 are raised approximately 30° to 45° above their horizontal positions. An advantage of arranging the assembly 250 in this manner is that it minimizes the extent to which the actuator 216 (FIG. 1) has to work against the spring 260 when raising the platform 22 to the floor position.

Figure 8:
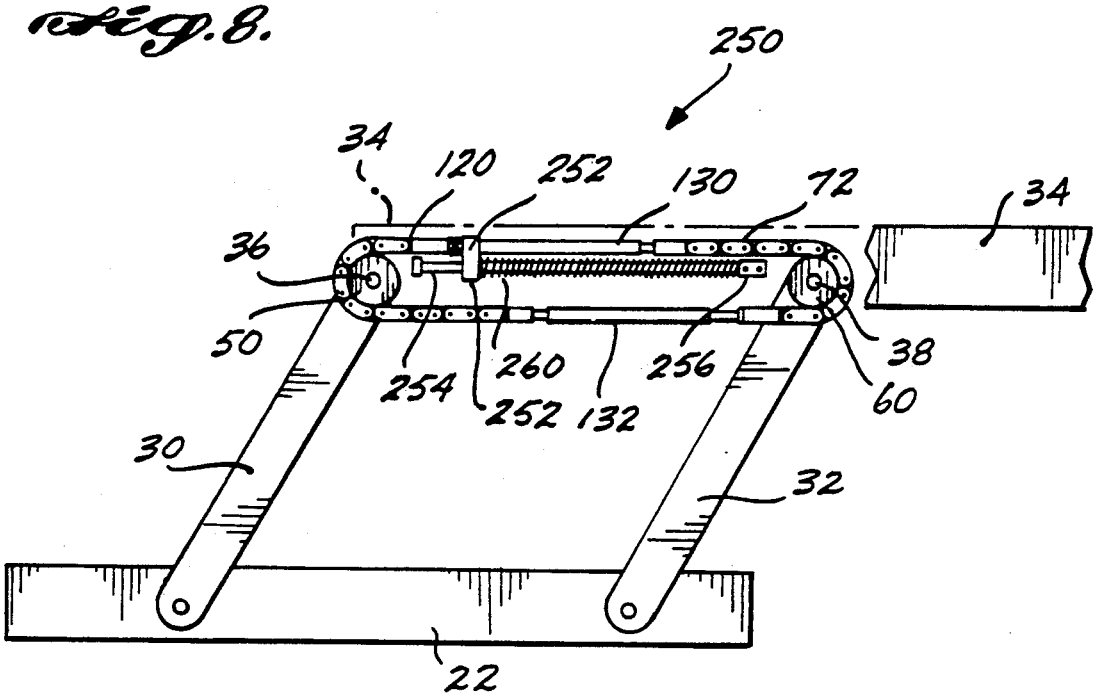
FIG. 8 is a side view of the lift assembly of FIG. 7 illustrating when the lift is in the ground position.
Figure 9:
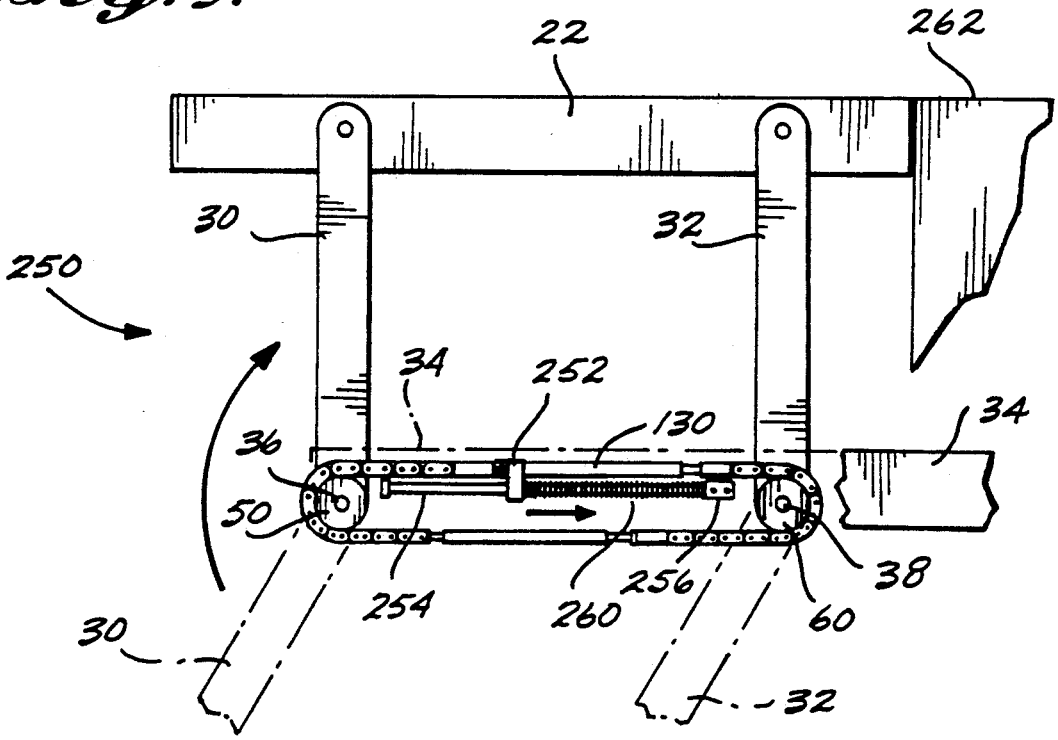
FIG. 9 is a side view of the lift assembly of FIG. 7 illustrating when the lift is raised to the floor position adjacent the floor of the vehicle in which the lift is installed.

When the platform 22, with which the drive assembly 250 of this invention is employed, is in the fully lowered, or ground, position, the traveling lug 252 is located in the most distal position relative to the fixed support lug 256 and the spring 260 is in the least compressed state as is depicted in FIG. 8. When the platform 22 is raised to the highest position, adjacent the floor 262 of the vehicle with which the platform is used, the movement of the leaf chain 72 and the turnbuckle 130 causes the traveling lug 252 to move along the fixed rod 254 towards the support lug 256 as depicted in FIG. 9. This movement maximizes the compression of the spring 260 between the traveling lug 252 and the support lug 256. In the depicted employment of this invention, when the platform 22 is in the floor position, the linkage arms 30 and 32 are in a top-center position, directly above the associated pivot shafts 36 and 38. When it is time to lower the platform 22, the linear actuator 216 is extended so as to release the tension on leaf chain 208 (FIG. 1). The release of tension on the leaf chain 208 serves to unlock the spring 260 so as to allow the spring to expand. The movement of the spring 260 urges the traveling lug 252 and associated turnbuckle 130 towards the driven shaft 50. This movement causes the leaf chains 72 and 120 and sheaves 50 and 60 to similarly turn so as to cause the rotation of the linkage arms past the top-center positions. Once the linkage arms are well past their top-center positions, gravity provides a sufficient force to move the platform 22 and linkage arms 30 and 32 downward to either the stowed or ground level position.

The spring-biased turnbuckle assembly 250 of this embodiment of the invention eliminates the need to spring load the torque shaft that is typically employed with platform lifts. Since there is no need to spring load the torque shaft, it is possible to provide a relatively economical and efficient one-piece torque shaft. Still another advantage of the assembly 250 of this embodiment of the invention is that the compression spring 260 is relatively economical to provide. Furthermore, the spring is mounted to an exposed portion of the lift assembly carriage arms 34; this makes access to the springs for maintenance or replacement purposes a relatively easy and economical task.

Figure 10:
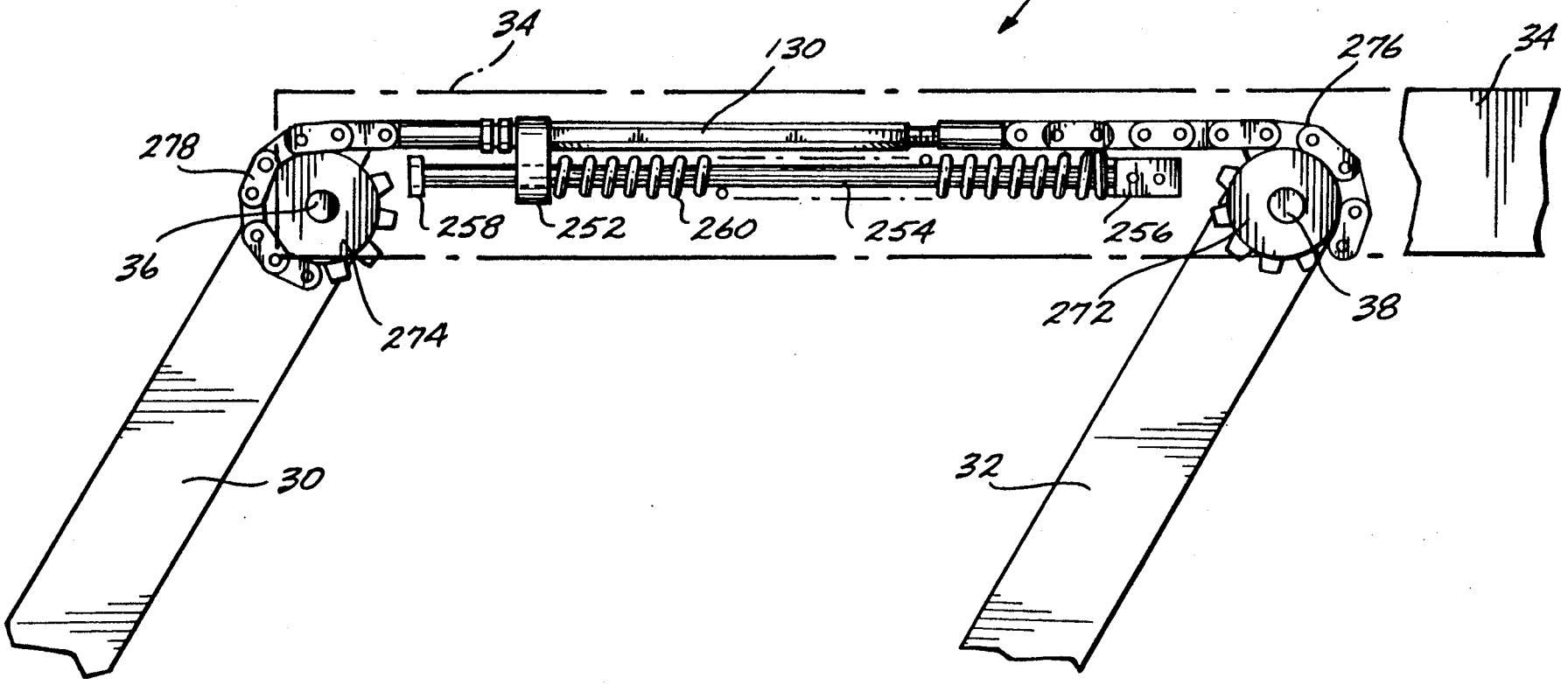
FIG. 10 is a side view illustrating an alternative embodiment of the spring-loaded turnbuckle assembly of this invention, wherein the turnbuckle is coupled to a roller-type chain assembly.

The use of the spring-biased turnbuckle assembly of this invention is not necessarily limited for use with drive assemblies with which leaf chains are employed or drive assemblies that employ endless loop drive chains. As depicted in FIG. 10, the spring-loaded turnbuckle assembly 270 may be used in conjunction with an open-ended roller chain-type drive chain. In this assembly 270, multi-tooth type sprockets 272 and 274 are substituted for the previously disclosed lug-type sheaves 50 and 60, respectively. A first roller-link section of chain 276 is secured at one end to driving sprocket 272 and wrapped partially around the sprocket. A second roller-link section of chain 278 securing at one end to the driven sprocket 274 and is wrapped partially around the sprocket. The free ends of the chains 276 and 278 are coupled to the opposed ends of turnbuckle 130 in a manner well known in the art. The turnbuckle 130 is spring-loaded relative to the carriage arm 34 in a manner previously described with respect to drive assembly 250. When a platform assembly which the drive assembly 270 is employed is brought to the floor position, the linkage arms 30 and 32 can be moved past the top-center positions by the release of the compression force of the spring 260 against the traveling lug 252 and the turnbuckle 130 in the manner previously described.

The foregoing description was for the purposes of illustration only. It will be apparent that variations and modifications can be made to this invention with the attainment of some or all of the advantages thereof. For example, in the depicted embodiment of the invention, the spring-biased turnbuckle is the upper or topmost located turnbuckle. In other embodiments of the invention, the biased turnbuckle may be located below the linkage arm pivot points. Moreover, it should be understood that the means of spring loading a drive linkage is meant to be illustrative, not limiting. In some embodiments of the invention, for example, it may be desirable to eliminate the turnbuckle and provide a lug that is attached to one of the chain links against which the spring exerts its force. In still other embodiments of the invention, it may be desirable to provide a spring that is disposed around a portion of the drive chain. In this embodiment of the invention, one end of the spring would be held static by a stop that is fixed to the carriage arm and the second end of the spring would be urged towards the fixed end by a lug or other member that extends from the drive change.

Therefore, the object of the appended claims is to cover all such variations and modifications that come within the true spirit and scope of the invention.

The embodiments of the invention in which an exclusive property or privilege is claimed are defined as follows:

1. A platform lift comprising:

a platform;

two linkage arms, each said linkage arm having a proximal end and a distal end opposite said proximal end and wherein said linkage arm distal ends are pivotably connected to separate platform pivot points on said platform;

a carriage arm having first and second carriage arm pivot points, wherein each said linkage arm proximal end is connected to a separate one of said carriage arm pivot points so that said platform can shift position relative to said carriage arm;

a first drive member attached to a first one of said linkage arms at said first carriage arm pivot point to rotate about said first carriage arm pivot point with movement of said first linkage arm;

a second drive member attached to a second one of said linkage arms at said second carriage arm pivot point to rotate about said second carriage arm pivot point with movement of said second linkage arm;

a drive linkage connected to said first and second drive members so as to cause said drive members to rotate simultaneously; and a biasing member connected at a first point to said drive linkage and at second point to said carriage arm and arranged to exert a force on said drive linkage so as to urge said drive linkage towards one of said drive members.

2. The platform lift of claim 1 wherein said biasing member is a spring connected at a first end to said drive linkage to move with said drive linkage and connected at a second end opposite said first end to said carriage arm.

3. The platform lift of claim 2 further including: a rod attached to said carriage arm, wherein said spring is disposed over said rod; and, a lug connected at a first end to said drive linkage so as to move with said drive linkage, wherein said lug is coupled at a second end to move over said rod and positioned adjacent said spring first end so that when said drive linkage moves in a first direction, said spring is compressed by said lug so that said spring urges said lug and said drive linkage in a direction opposite said first direction.

4. The platform lift of claim 1 wherein:

each said drive member comprises a circular member;

said drive linkage comprises a chain assembly wrapped at least partially about each said drive member; and said biasing member comprises a spring having a first end connected to said chain assembly so as to move with said chain assembly and a second end connected to said carriage arm.

5. The platform lift of claim 4, wherein said drive members each comprise a sheave and said drive linkage comprises a leaf chain assembly.

6. The platform lift of claim 5 further including: a rod attached to said carriage arm, wherein said spring is disposed over said rod; and, a lug connected at a first end to to said leaf chain assembly so as to move with said leaf chain assembly, wherein said lug is coupled at a second end opposite said first end to move over said rod and positioned adjacent said spring first end so that when said leaf chain assembly moves in a first direction, said spring is compressed by said lug so that said spring urges said lug and said leaf chain assembly in a direction opposite said first direction.

7. The platform lift of claim 6 wherein said leaf chain assembly includes two separate leaf chains, wherein each said leaf chain is coupled to a separate one of said drive sheaves and each said leaf chain further includes a free end, and whereas said platform lift further includes a turnbuckle connecting said free ends of said leaf chains together, wherein said lug is attached to said turnbuckle.

8. The platform lift of claim 4 wherein each said drive member comprises a multi-tooth sprocket and said drive linkage comprises a roller chain assembly disposed partially around each said drive sprocket so as to cause said drive sprockets to rotate in unison.

9. The platform lift of claim 8 further including: a rod attached to said carriage arm, wherein said spring is disposed over said rod; and, a lug connected at a first end to to said roller chain assembly so as to move with said roller chain assembly, wherein said lug is coupled at a second end to move over said rod and positioned adjacent said spring first end so that when said roller chain assembly moves in a first direction, said spring is compressed by said lug so that said spring urges said lug and said roller chain assembly in a direction opposite said first direction.

10. The platform lift of claim 9 wherein said roller chain assembly includes two separate chain sections wherein each said chain section is at least partially disposed around a separate one of said sprockets and has at least one free end, and wherein said platform lift further includes a turnbuckle connecting said chain free ends together and wherein said lug is attached to said turnbuckle.

11. The platform lift of claim 2 wherein said spring is arranged to exert a maximum force on said drive linkage when said platform is in a raised position relative to said carriage arm and said linkage arms are approximately at a top-center position relative to said first and second carriage arm pivot points.

12. The platform lift of claim 4 wherein said spring is arranged to exert a maximum force on said drive linkage when said platform is in a raised position relative to said carriage arm and said linkage arms are approximately at a top-center position relative to said first and second carriage arm pivot points.

13. The platform lift of claim 8 wherein said spring is arranged to exert a maximum force on said drive linkage when said platform is in a raised position relative to said carriage arm and said linkage arms are approximately at a top-center position relative to said first and second carriage arm pivot points.

14. The platform lift of claim 2 wherein said drive linkage is attached at opposed ends to each said drive member.

15. The platform lift of claim 2 wherein said drive linkage is in the form of a closed loop.

* * * * *

UNITED STATES PATENT AND TRADEMARK OFFICE

CERTIFICATE OF CORRECTION

PATENT NO. : 5,111,912

DATED : May 12, 1992

INVENTOR(S) : D. Kempf

It is certified that error appears in the above-identified patent and that said Letters Patent is hereby corrected as shown below:

On the title page, In the Abstract, line 8, "sprokets" should read —sprockets—.

Col. 1 line 56, "a actuator" should read —an actuator—
Col. 2 line 7, "A roller" should read —a roller—
Col. 2 line 65, "form" should read —from—
Col. 6 line 39, "cross sectional" should read —cross-sectional—
Col. 12, Claim 6, line 58, "to to said" should read —to said—
Col. 13, Claim 9, linr 14, "to to said" should read —to said—

Signed and Sealed this

Twenty-third Day of November, 1993

*Attest:*

Bruce Lehman

BRUCE LEHMAN

*Attesting Officer*

*Commissioner of Patents and Trademarks*